US010196173B2

(12) United States Patent
Tiramani

(10) Patent No.: US 10,196,173 B2
(45) Date of Patent: Feb. 5, 2019

(54) NESTABLE DUAL-CONFIGURATION STORAGE AND DISPLAY CONTAINER

(71) Applicant: 500 Group Inc., Greenwich, CT (US)

(72) Inventor: Paolo Tiramani, Greenwich, CT (US)

(73) Assignee: 500 Group, Inc., Las Vegas, NV (US)

( * ) Notice: Subject to any disclaimer, the term of this patent is extended or adjusted under 35 U.S.C. 154(b) by 137 days.

(21) Appl. No.: 15/241,446

(22) Filed: Aug. 19, 2016

(65) Prior Publication Data

US 2017/0050760 A1 Feb. 23, 2017

Related U.S. Application Data

(60) Provisional application No. 62/207,606, filed on Aug. 20, 2015.

(51) Int. Cl.

| | |
|---|---|
| ***B65D 6/24*** | (2006.01) |
| ***B65D 6/00*** | (2006.01) |
| ***B65D 5/32*** | (2006.01) |
| ***B65D 5/34*** | (2006.01) |
| ***B65D 21/02*** | (2006.01) |

(52) U.S. Cl.

CPC ..... *B65D 11/1886* (2013.01); *B65D 5/324* (2013.01); *B65D 5/325* (2013.01); *B65D 11/105* (2013.01); *B65D 11/1893* (2013.01); *B65D 21/0201* (2013.01); *B65D 21/0204* (2013.01)

(58) Field of Classification Search

CPC .. B65D 11/105; B65D 11/1886; B65D 5/324; B65D 5/325; B65D 9/14; B65D 11/1893

USPC ..... 220/DIG. 25, 4.23, 4.24; 229/122.23

See application file for complete search history.

(56) References Cited

U.S. PATENT DOCUMENTS

| | | | | |
|---|---|---|---|---|
| 2,620,941 A | | 12/1952 | Smulski | |
| 2,889,102 A | | 6/1959 | Wagaman | |
| 3,272,419 A | | 9/1966 | Vineberg | |
| 3,335,935 A | | 8/1967 | McCallum | |
| 4,010,865 A | * | 3/1977 | Wilgus | B65D 1/225 220/6 |
| 4,235,346 A | * | 11/1980 | Liggett | B65D 1/225 220/6 |
| 5,582,312 A | | 12/1996 | Niles | |
| 8,167,157 B2 | * | 5/2012 | Shalomoff | B65D 11/1833 220/4.08 |

OTHER PUBLICATIONS

International Search and Written Opinion from related International patent application No. PCT/US2016/047717 dated Nov. 4, 2016.

* cited by examiner

*Primary Examiner* — Jeffrey Allen
*Assistant Examiner* — Jennifer Castriotta
(74) *Attorney, Agent, or Firm* — McCarter & English, LLP

(57) ABSTRACT

A container assembly including a number of sidewall assemblies is provided. Each sidewall assembly includes a number of sidewalls. Each sidewall includes a generally planar perimeter and a number of tapered edge segments. The sidewalls are disposed in an enclosing configuration wherein a number of the tapered edge segments overlap. The sidewalls define a generally enclosed space. Further, each overlapping tapered edge segment is coupled to an adjacent overlapping tapered edge segment.

9 Claims, 7 Drawing Sheets

NESTABLE DUAL-CONFIGURATION STORAGE AND DISPLAY CONTAINER

CROSS REFERENCE TO RELATED APPLICATION

This application is a traditional application of and claims priority to U.S. Provisional Patent Application Ser. No. 62/207,606, filed Aug. 20, 2015 entitled, CONTAINER.

BACKGROUND OF THE INVENTION

Field of the Invention

The disclosed and claimed concept relates to containers and, more specifically a container that is transportable prior to use in a nested configuration, and, when used in an enclosed configuration, includes reinforced couplings.

Background Information

One type of container is of moderate size and multipurpose. For example, milk crates are a moderate size container which are commonly repurposed to store a variety of objects. Milk crates have proven to be so popular that the design has been copied or emulated as general purpose containers, hereinafter "moderate sized containers." These moderate sized containers are used both for moving objects and for storing/displaying objects. That is, as shown in FIG. 1, such moderate sized containers 1 include five generally planar sidewalls 2 defining an enclosed space 3 as well as one sidewall that defines a "primary opening" 4. As used herein, a "primary opening" is an opening substantially the same size as the sidewall that defines it. Such a primary opening allows the user to access the enclosed space and allows for the moderate sized containers to be used to display objects. It is noted that when such moderate sized containers are used for displaying objects, several moderate sized containers are often stacked in a matrix to create a bookshelf-like assembly. Such moderate sized containers, however, have several disadvantages including disadvantages relating to the configuration of the moderate sized containers when being transported prior to use, i.e. a shipping configuration (wherein the moderate sized containers are being shipped and are not being used to ship other objects) and the configuration of the moderate sized containers when in use, i.e. a use configuration.

That is, for example, a milk crate-like moderate sized container is substantially rigid owning in part to a unitary construction and numerous supporting ribs on the sidewalls. In this embodiment, the shipping configuration and the use configuration is the same as the moderate sized containers cannot be altered. Moreover, because such moderate sized containers are generally the same size, transportation of the moderate sized containers prior to use, i.e. when being shipped to a reseller, is inefficient because the moderate sized containers cannot be nested. Stated alternately, the density of the moderate sized containers in a shipping configuration is very low. While such moderate sized containers could be reconfigured with tapered walls, so as to allow nesting, this shape would be less useful as the tapered moderate sized containers could not be stacked in a bookshelf-like configuration when in use.

Alternatively, moderate sized containers are made from separate sidewalls or sidewall assemblies that are coupled together. In this configuration, the sidewalls do not include support ribs or other elements that extend substantially out of the plane of the sidewall. In this configuration, such separate sidewalls/sidewall assemblies may be stored in a stacked/nested configuration for shipping. That is, the density of the containers during shipping is relatively high. When such moderate sized containers are assembled, however, the moderate sized containers have several disadvantages. That is, a five-sided container is weak along the four edges that extend generally normal to the plane of the primary opening. Generally, because the sidewall at the primary opening is mostly absent, the other sidewalls are not stiffened and may collapse in a hinge-like manner. Stated alternately, loads on a limited number of the five sidewalls are not transferred to the other sidewalls, thereby causing the container to collapse. Such moderate sized containers could include additional supports, such as gussets, but such additional elements add to the cost and the assembly time of the moderate sized containers.

There is, therefore, a need for a moderate sized container that can be configured in a high density configuration for shipping, and, which can be configured to transfer loads when in use. There is a further need for such a moderate sized container to be inexpensive and to be easily assembled without substantial additional hardware.

SUMMARY OF THE INVENTION

These needs, and others, are met by at least one embodiment of the disclosed and claimed concept which provides a container assembly including a number of sidewall assemblies. Each sidewall assembly includes a number of sidewalls. Each sidewall includes a generally planar perimeter and a number of tapered edge segments. The sidewalls are disposed in an enclosing configuration wherein a number of the tapered edge segments overlap. The sidewalls define a generally enclosed space. Further, each overlapping tapered edge segment is coupled to an adjacent overlapping tapered edge segment. In this configuration, each set of coupled tapered edge segments defines a reinforced edge.

Further, each sidewall assembly is movable between a generally flat, first configuration, wherein the planes of the sidewalls are generally parallel, and a folded, second configuration, wherein the planes of the sidewalls are generally perpendicular to each other. When the sidewall assembly is in the first configuration, each sidewall assembly is nestable with a substantially similar sidewall assembly. Thus, a number of similar sidewall assemblies may be shipped or stored in a nested configuration with a high density. In an exemplary embodiment, the sidewall assemblies are structured to closely correspond to an adjacent sidewall assembly when nested.

It is noted that the shape and configuration(s) of the container assembly set forth below solve the stated problems, i.e. that is, the disclosed container assembly solves the problems associated with both the shipping configuration and the use configuration. By way of non-limiting example, the disclosed shape of a sidewall assembly in the first configuration, described below, allows for the sidewall assemblies to be nested in a high density configuration, while the disclosed shape of a sidewall assembly in the enclosed configuration, described below, allows for loads to be transferred between sidewalls.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
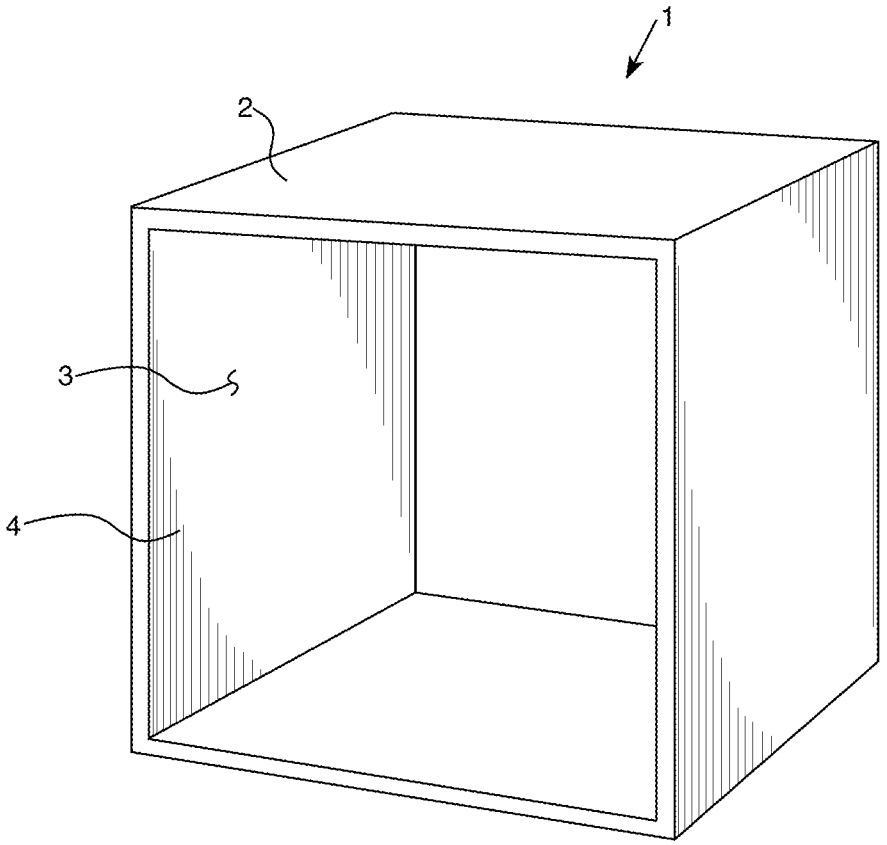
FIG. 1 (Prior Art)
FIG. 1 is an isometric view of a prior art container.

As used herein, the singular form of "a," "an," and "the" include plural references unless the context clearly dictates otherwise.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut. It is further understood that an opening or passage through which another coupling component extends is also a coupling component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, a first object resting on a second object, which is held in place only by gravity, is not "coupled" to the second object unless the first object is otherwise linked to the second object. That is, for example, a book on a table is not coupled thereto, but a book glued to a table is coupled thereto.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that a slot or opening is sized to be larger than an element disposed therein. This means that the increased size of the slot or opening is intentional and is more than a manufacturing tolerance. Further, with regard to a surface formed by two or more elements, a "corresponding" shape means that surface features, e.g. curvature and contours, are similar.

As used herein, "structured to [verb] or 'be an [X]'" means that the identified element or assembly has a structure that is shaped, sized, disposed, coupled and/or configured to perform the identified verb or to be what is identified in the infinitive phrase. For example, a member that is "structured to move" is movably coupled to another element and includes elements that cause the member to move or the member is otherwise configured to move in response to other elements or assemblies. As such, as used herein, "structured to [verb] or 'be an [X]'" recites structure and not function. Further, as used herein, "structured to [verb] or 'be an [X]'" means that the identified element or assembly is intended to, and is designed to, perform the identified verb or to be an [X]. Thus, an element that is only possibly "capable" of performing the identified verb but which is not intended to, and is not designed to, perform the identified verb is not "structured to [verb] or 'be an [X]'."

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, a "tapered edge segment" is a sidewall segment that is angled relative to the plane of a generally planar sidewall perimeter. As used herein a "sidewall perimeter" means substantially all of the perimeter extending about, i.e. around, the sidewall. That is, a small portion of a sidewall perimeter does not, as used herein, define the plane of the sidewall perimeter. Further, as used herein, "angled" means other than a substantially right angle, i.e. a 90° angle.

As used herein, an "edge segment" is a body disposed along the edge, i.e. boundary, of another body. As used herein, a "planar edge segment" is a generally planar body disposed along the edge of another body. An "edge segment" does not always, but may in certain locations, define an edge.

As used herein, "nesting" or "nested" means that two bodies having a corresponding shape are disposed with one body substantially adjacent the other body with the corresponding contours aligned, i.e. wherein the adjacent surfaces of the bodies at a small localized area are generally parallel. It is understood that, when nesting bodies include a tapered portion, the tapered portions of the nesting bodies contact each other while other portions of the nesting bodies do not contact each other. It is understood that during the act of inserting a component into a "nesting" component, the two components may touch; however, a first component that corresponds to a second component may be positioned within the second component without substantial contact between the non-tapered portion of the nesting bodies.

As used herein, "closely corresponding" nested bodies have a "small gap" therebetween the non-contacting portions thereof. A "small gap," as used herein, is proportional to the thickness of nesting bodies. That is, a "small gap" is about twice the size as a local thickness of the nesting bodies. That is, the "local thickness" is the thickness of the body at a small, specific area. By way of example, a corrugated generally planar body has a general thickness that is determined by the height/depth of the corrugations. The "local thickness" is the thickness of the body that defines the corrugations.

Further, nesting bodies may include stand-off elements. As used herein, a "stand-off element" is a lug or similar construct structured to contact an adjacent nesting body while keeping the other portions of the nesting bodies from contacting each other.

Further, as used herein, "narrowly correspond" means that the gap between two nesting components is between about 0.01 and 0.1 inch.

As used herein, a "reinforced edge" is a configuration of overlapping coupled elements that substantially transfers loads and stresses between the coupled elements.

Figure 2:
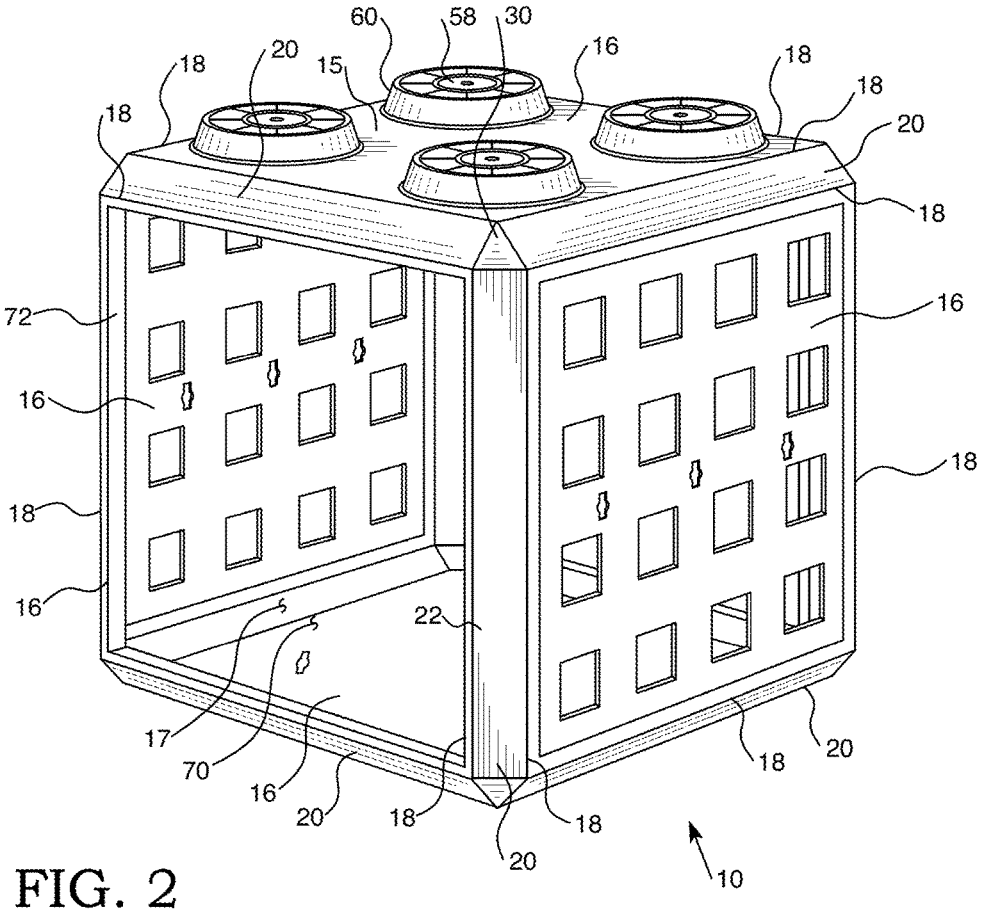
FIG. 2 is an isometric view of a container assembly.
Figure 3:
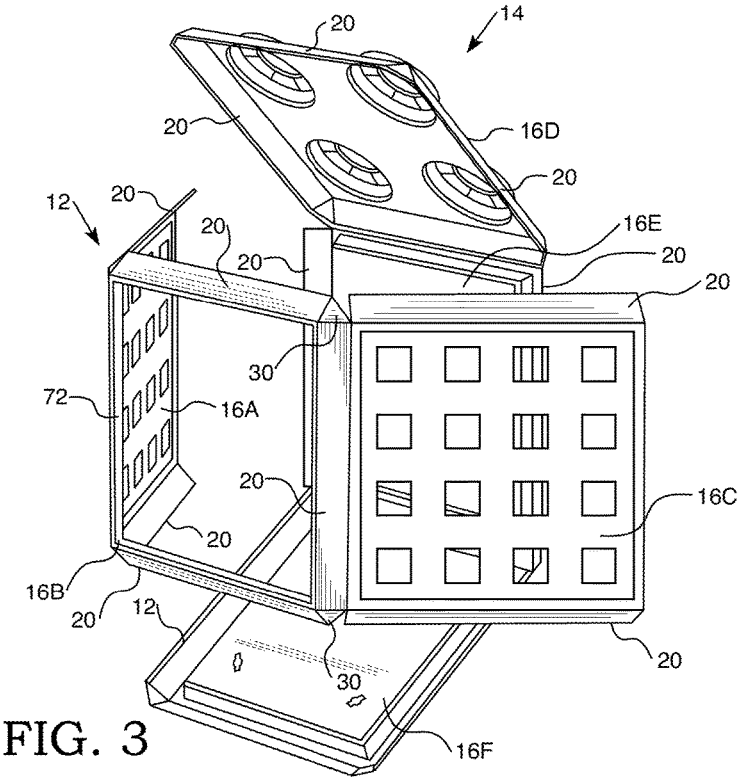
FIG. 3 is an exploded isometric view of a container assembly.

As shown in FIGS. 2 and 3, a container assembly 10 (FIG. 2) includes a number of sidewall assemblies 12, 14 (shown separated in FIG. 3). That is, in an exemplary embodiment as shown, there is a first sidewall assembly 12 and a second sidewall assembly 14. The embodiment shown in the Figures is exemplary; that is, the embodiment shown is a six-sided, generally cube-like container with generally planar sides. The disclosed and claimed concept is not limited to this configuration. Further, in this configuration, there could alternately be, for example, three two-sided sidewall assemblies (not shown), or six one-sided sidewall assemblies (not shown). Each sidewall assembly 12, 14 includes a number of sidewalls 16. In the embodiment shown, there are six generally planar sidewalls 16A, 16B, 16C, 16D, 16E, 16F. Each sidewall includes a generally planar perimeter 18 and a number of tapered edge segments 20. In an exemplary embodiment, the sidewall assemblies 12, 14 are made from a molded material, such as, but not limited to, plastic and poly materials. Such materials are generally rigid and, as such, the tapered edge segments 20, as defined above, remain "angled" relative to the associated sidewall 16. As the tapered edge segments 20 solve the stated problems, the material that maintains the segments as tapered edge segments 20 at an angle is also an element of solving the stated problems. The sidewalls 16 are disposed in an enclosing configuration wherein a number of the tapered edge segments 20 overlap. In this configuration, the sidewalls 16 define a generally enclosed space 17. As used herein, a "generally enclosed space" includes, but is not limited to, a parallelepiped space having one open side.

Figure 4:
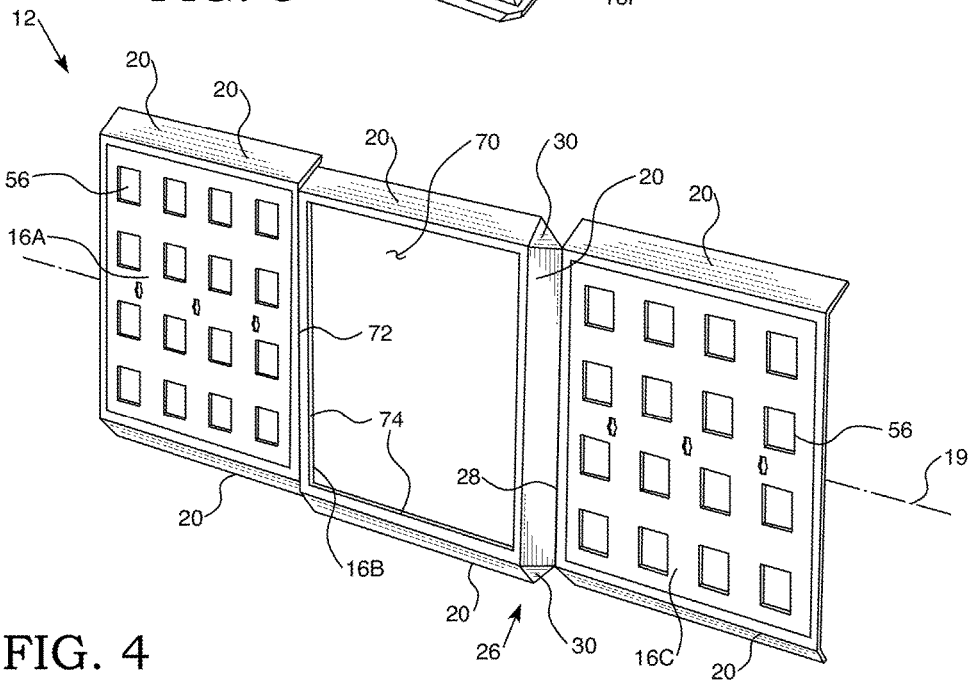
FIG. 4 is an isometric view of a sidewall assembly.
Figure 5:
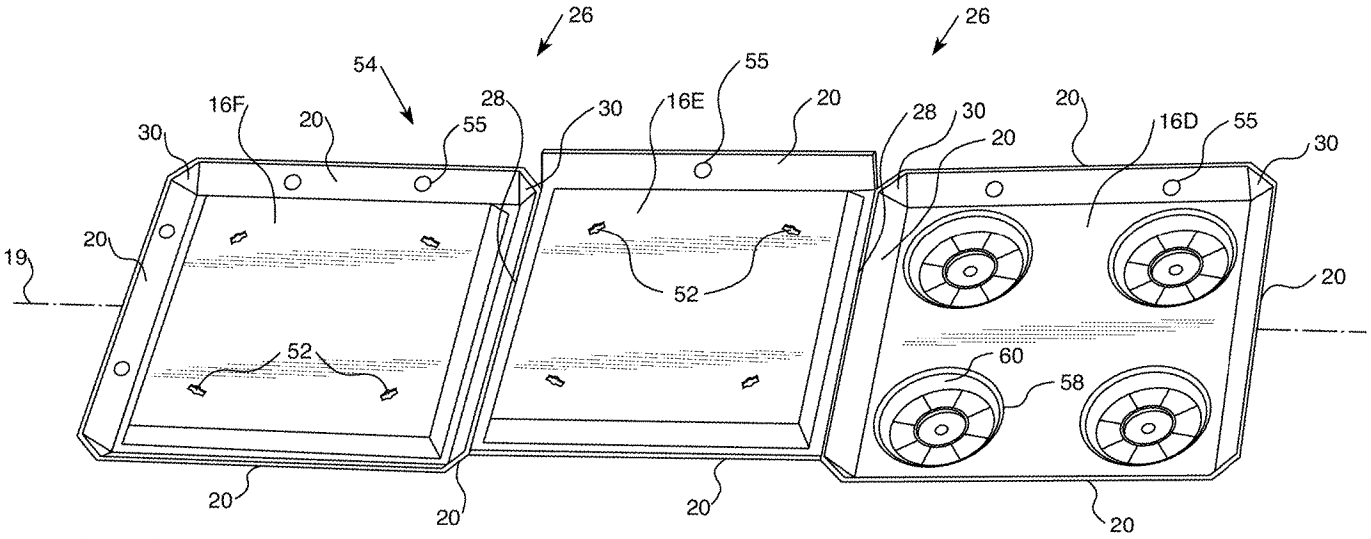
FIG. 5 is an isometric view of another sidewall assembly.

In an exemplary embodiment, and as shown in FIGS. 4 and 5, each sidewall assembly 12, 14 includes plurality of associated sidewalls 16 and, as shown, three sidewalls, 16A, 16B, 16C, which are associated with the first sidewall assembly 12, and 16D, 16E, 16F, which are associated with the second sidewall assembly 16. In an exemplary embodiment, the three associated sidewalls 16 of each sidewall assembly 12, 14 are disposed in series, i.e. in a line which defines a longitudinal axis 19. Further, and because there are three sidewalls 16 in each sidewall assembly 12, 14 it is inherent that there is a medial sidewall, e.g. sidewall 16B, and two outer sidewalls, e.g. 16A, 16C. In an exemplary embodiment, each sidewall 16 is a generally rectangular or generally square body 15. In this configuration, each sidewall 16 defines the perimeter 18 which is also generally planar. It is noted that a body, such as, but not limited to a convex body (not shown) may also define a generally planar perimeter.

Each tapered edge segment 20 is disposed on the edge of a sidewall 16, i.e. along a portion of the sidewall perimeter 18. In an exemplary embodiment, each tapered edge segment 20 is a generally planar body 22, i.e. a planar edge segment, having a length substantially corresponding to the length of the associated sidewall side from which it depends. As used herein, "depends" means extends from. A tapered edge segment 20 is associated with the sidewall 16 from which it depends and which it remains at a fixed angle to; that is, a tapered edge segment 20 is not "associated" with a sidewall 12 to which is coupled by a hinge 26, discussed below. As defined above, a tapered edge segment 20 is disposed at an angle relative to the plane of the associated sidewall 16. In an exemplary embodiment, as shown, the sidewalls 16 are generally square and the tapered edge segments 20 are angled about 45° relative to the plane of the associated sidewall 16. In other embodiments, not shown, the tapered edge segments 20 are angled between about 30° and 60° relative to the plane of the associated sidewall 16.

In this configuration, there is small gap between tapered edge segments 20 depending from adjacent, perpendicular sides of the same associated sidewall 16. In an exemplary embodiment, a triangular gusset 30 is disposed between tapered edge segments 20 depending from adjacent, perpendicular sides of the same associated sidewall 16. That is, each sidewall assembly 12, 14 includes generally a number of triangular gussets 30. In the exemplary configuration shown, each triangular gusset 30 is a generally equilateral triangle with an altitude that extends generally 45° relative to the plane of the associated sidewall 16.

In an exemplary embodiment, each sidewall assembly 12, 14 is a unitary body. That is, the three associated sidewalls, 16A, 16B, 16C or 16D, 16E, 16F, are made from a plastic or poly material as one piece. Thus, each outer sidewall 16 is movably coupled to the medial sidewall 16. In an exemplary embodiment, each outer sidewall 16A, 16C, and 16D, 16F is movably coupled to the associated medial sidewall 16B, 16E by a hinge 26 and, as shown, a living hinge 28. That is, each outer sidewall 16A, 16C, 16D, 16F is movably coupled to the tapered edge segments 20 of the medial sidewall 16B, 16E. Use of a unitary body removes the need for additional hardware, such as a separate hinge, and solves the problems noted above.

It is noted that the first and second sidewall assemblies 12, 14 have only one tapered edge segment 20 between adjacent sidewalls 16. Thus, in the exemplary configuration, not all sidewalls 16 have associated tapered edge segments 20 depending from each side. In an exemplary embodiment, as shown, the first sidewall assembly outer sidewalls 16A, 16C include tapered edge segments 20 on the longitudinal sides thereof, i.e. the sides extending parallel to the longitudinal axis 19. The first sidewall assembly medial sidewall 16B includes tapered edge segments 20 on all four sides. Thus, the proximal lateral sides of first sidewall assembly outer sidewalls 16A, 16C are movably coupled to the tapered edge segments 20 of the first sidewall assembly medial sidewall 16B by a living hinge 28. Further, as shown, the second sidewall assembly outer sidewalls 16D, 16F include tapered edge segments 20 on all four sides, while the second sidewall assembly medial sidewall 16E includes tapered edge segments 20 on the longitudinal sides. When the tapered edge segments 20 are disposed in this arrangement, and when the first and second sidewall assemblies 12, 14 are in the enclosed configuration, the tapered edge segments 20 overlap each other in pairs. That is, only two tapered edge segments 20 overlap each other at any given location. Stated alternately, there are no locations wherein more than two tapered edge segments 20 overlap. This is also true of the gussets 30; i.e. in an exemplary embodiment, there are no locations wherein more than two gussets 30 overlap.

Each sidewall assembly 12, 14 is movable between a generally flat, first configuration, wherein the planes of the associated sidewalls 16A, 16B, 16C or 16D, 16E, 16F are generally parallel, and a folded, second configuration, wherein the planes of said associated sidewalls 16A, 16B, 16C or 16D, 16E, 16F are generally perpendicular to each other. As used herein, the sidewalls 16 with tapered edge segments 20 are "generally planar." That is, while the offset of the tapered edge segments 20 is greater than the thickness of the planar sidewalls 16, the size, i.e. cross-sectional area of the sidewalls 16 is substantially greater than the offset of the tapered edge segments 20, thus the disclosed sidewalls 16 with tapered edge segments 20 are "generally planar" when in the first configuration.

When the first and second sidewall assemblies 12, 14 are in the second configuration, each sidewall assembly 12, 14 defines a generally square U-shaped construct. As shown in FIG. 2, the first and second sidewall assemblies 12, 14 in the second configuration may be joined to define the enclosed space 17 shown in FIG. 1. In the "enclosed configuration," which, as used herein, means a configuration that defines an enclosed space, the first sidewall assembly tapered edge segments 20 and the second sidewall assembly tapered edge segments 20 overlap each other, as shown partially in FIG. 6. As such, the overlapping sets of tapered edge segments 20 are coupled so as to define a reinforced edge. In an exemplary embodiment, each set of coupled tapered edge segments 20 is one of a "fastened reinforced edge," "an adhered reinforced edge," or a "bonded reinforced edge." As used herein, a "fastened reinforced edge" means that the set of coupled tapered edge segments 20 are coupled by a number of mechanical fasteners such as, but not limited to, snaps, clips, screws, and/or nuts-and-bolts. As used herein, an "adhered reinforced edge" means that the set of coupled tapered edge segments 20 are coupled by an adhering agent such as, but not limited to, glue and/or doubled sided tape. As used herein, a "bonded reinforced edge" means that the set of coupled tapered edge segments 20 are fused together, e.g. heated and/or chemically melted and fused.

The gussets 30 overlap in a manner similar to the tapered edge segments 20. Thus, the description in the paragraph above is also applicable to the gussets 30.

It is noted that because the tapered edge segments 20 (and gussets 30) are at an angle to the sidewalls 16 when the sidewall assemblies 12, 14 are in the enclosed configuration, a load applied, to, or near, a tapered edge segment 20 (and/or a gusset 30) is transferred to both the adjacent sidewalls 16. Thus, the disclosed configuration solves the problems stated above.

Figures 7, 7A:
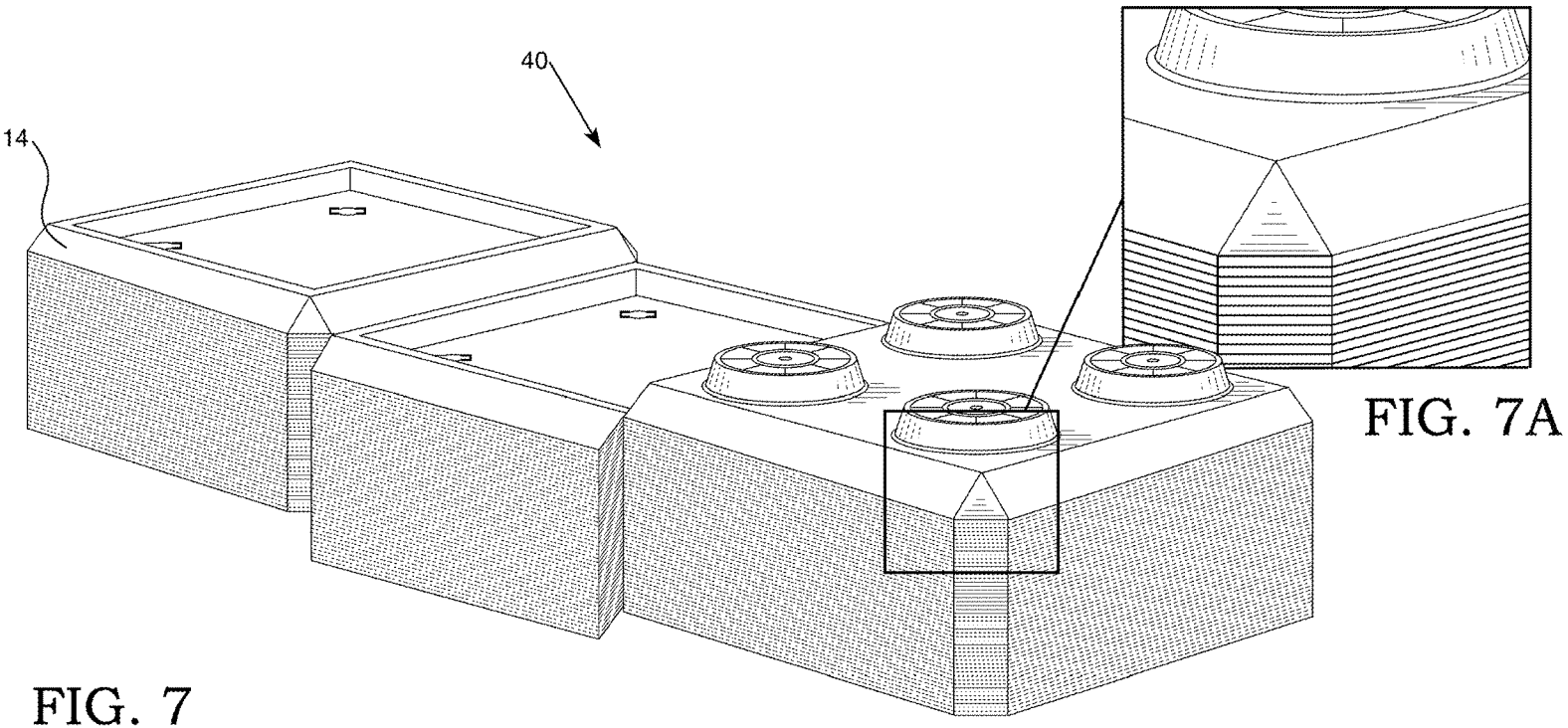
FIG. 7 is an isometric view of a stack of nested sidewall assemblies.
FIG. 7A is a detail view of a stack of nested sidewall assemblies.

Further, when the first and second sidewall assemblies 12, 14 are in the first configuration, each type of sidewall assemblies 12, 14 may be nested with similar sidewall assemblies 12, 14. That is, each sidewall assembly 12, 14 is structured to be nested with a substantially similar sidewall assembly 12, 14 and, as shown in FIG. 7, is nestable with a substantially similar sidewall assembly. When nested, the first and second sidewall assemblies 12, 14 form a stack 40 (only sidewall assembly 14 shown). In an exemplary embodiment, when the first and second sidewall assemblies 12, 14 are in the first configuration, each sidewall assembly 12, 14 is structured to closely correspond or narrowly correspond to an adjacent sidewall assembly when nested. Thus, when the first and second sidewall assemblies 12, 14 are in stack 40, each similar sidewall assembly 12, 14 closely corresponds or narrowly corresponds to the adjacent sidewall assembly 12, 14. As shown in FIG. 7A, there is a small gap between adjacent nested second sidewall assemblies 14. In this configuration, there is a high density of the first and second sidewall assemblies 12, 14 when shipped or stored. Thus, the disclosed configuration solves the problems stated above.

Figure 6:
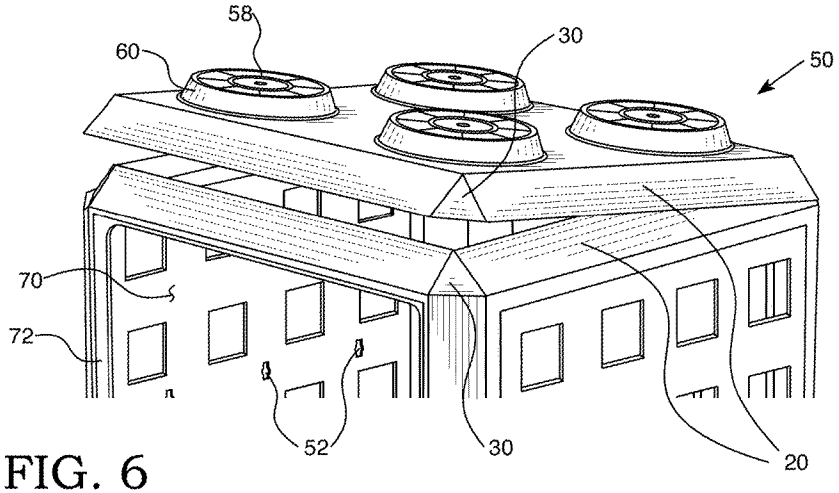
FIG. 6 is an isometric view of partially overlapped tapered edge segments.
Figure 8:
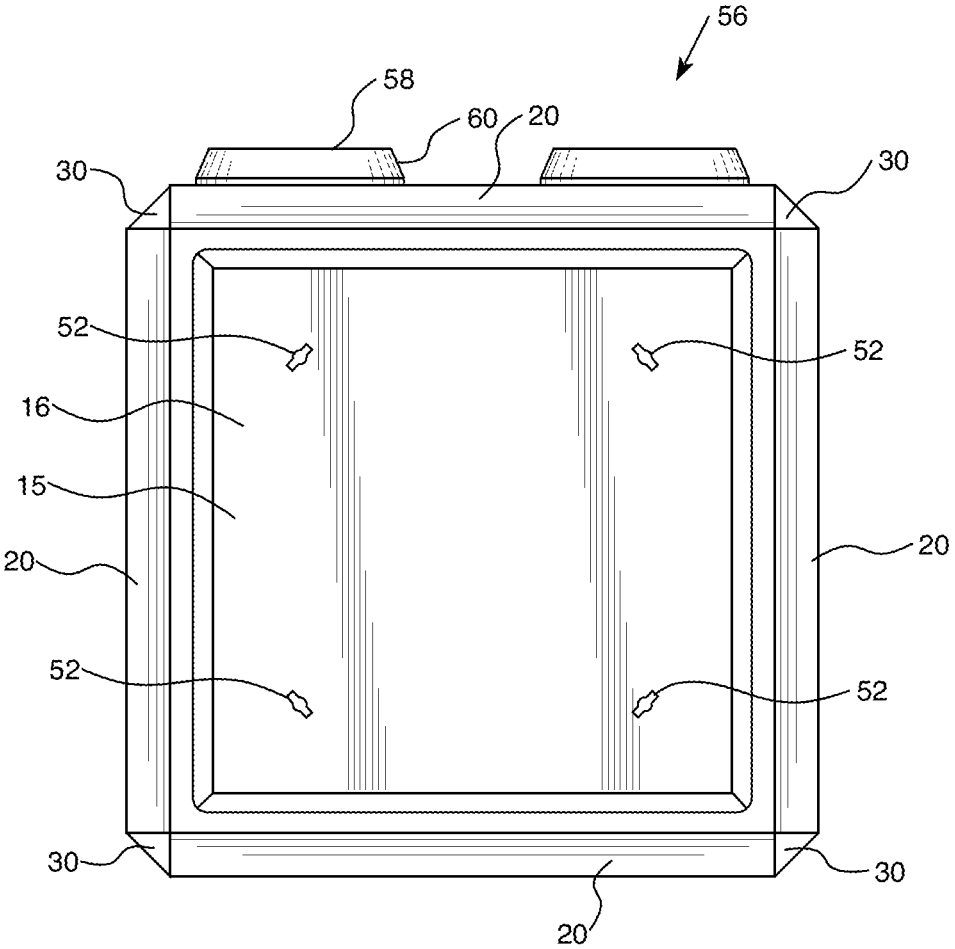
FIG. 8 is a side view of a container assembly.
Figure 9:
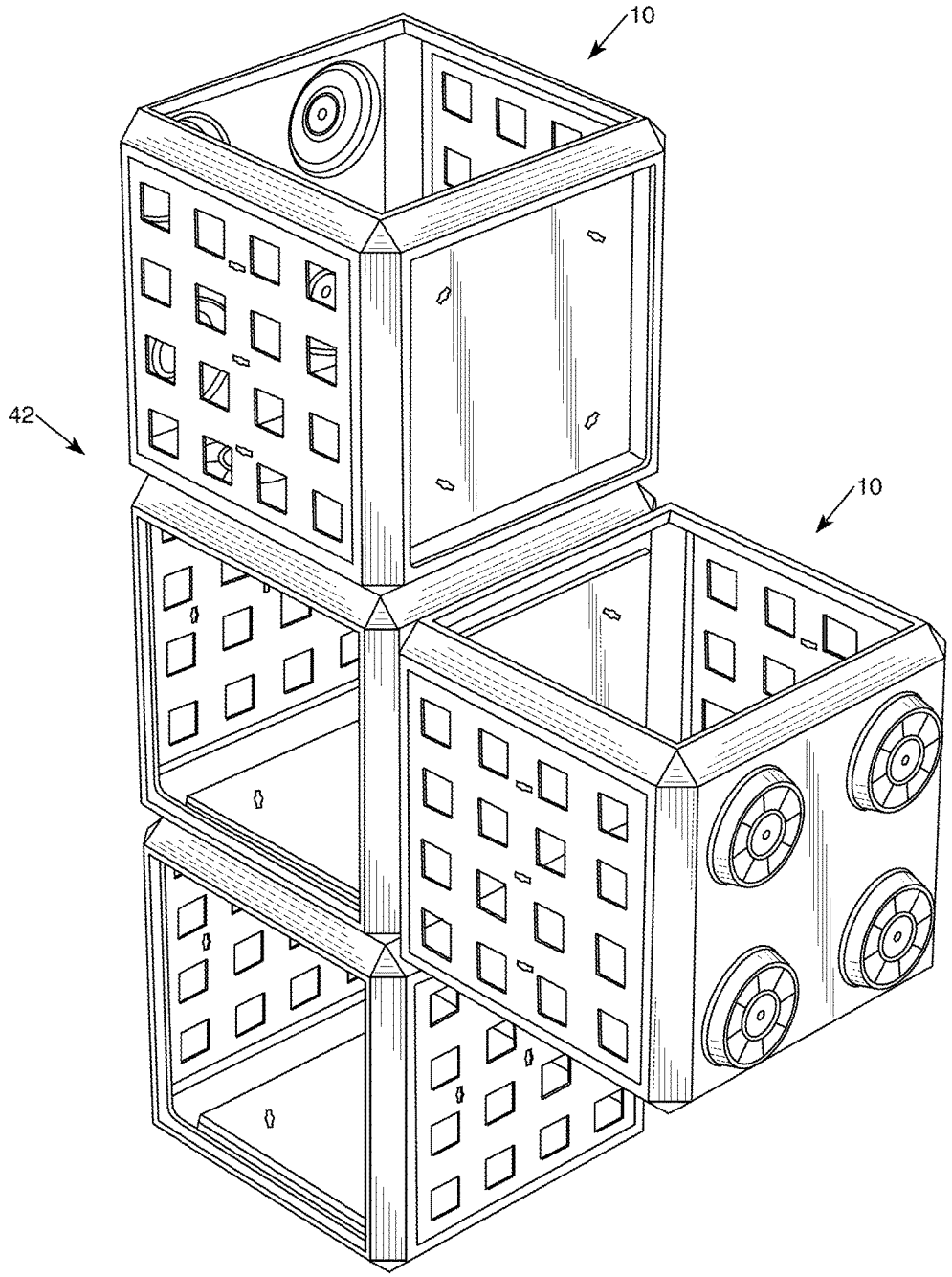
FIG. 9 is an isometric view of container assemblies assembled in a matrix.

In an exemplary embodiment, and as shown in FIGS. 6 and 8, the sidewalls 16 include a number of additional features 50. As shown, the features 50 are selected from the group including coupling components 52, stand-off elements 54, windows 56 and risers 58. A coupling component 52 is structured to allow container assemblies 10 in the enclosed configuration to be coupled together in a matrix 42. The coupling component 52 may be, but are not limited to, passages through which a fastener is passed, snaps, and clips, including snaps/clips that are unitary with the sidewall 16. Stand-off elements 54 include, but are not limited to lugs 55 structured to maintain a gap or small gap between nested sidewall assemblies 12, 14. That is, each stand-off element 54 has a height that is equal or less than a small gap. A window 56 is a small opening in a sidewall 16 that allows a user to see what is in the enclosed space 17. A riser 58 is a portion of a sidewall 16 that is offset relative to the plane of the sidewall 16. A riser 58 spaces adjacent container assemblies 10 when the container assemblies 10 are stacked. Similar to the tapered edge segments 20 described above, the size and offset of a riser 58 does not exclude a sidewall 16 having a riser 58 from being a "generally planar member" as defined herein. Further, the lateral wall 60 of a riser, i.e. the wall generally normal to the associated sidewall, may be tapered. The taper of the riser lateral wall 60 is, in an exemplary embodiment, tapered at more than a 45° angle. As such, when the similar sidewall assemblies 12, 14 are nested, the riser lateral walls 60 on adjacent sidewall assemblies 12, 14 in the stack of nested sidewall assemblies 12, 14 will engage each other. In an exemplary embodiment, the angle of the riser lateral wall 60 is structured so that the other portions of the similar sidewall assemblies 12, 14 have a small gap therebetween or so that the similar sidewall assemblies 12, 14 narrowly correspond to each other.

Further, sidewall 16B includes a primary opening 70. In an exemplary embodiment, the primary opening 70 is defined by a collar 72. The collar 72 includes a number of generally planar panels 74. The plane of each panel 74 extends generally normal to the plane of sidewall 16B. As used herein, that fact that primary opening 70 occupies a substantial portion of sidewall 16B does not prevent sidewall 16B from being a "sidewall." Further, the plane of a sidewall 16 defining a primary opening 70 is the plane defined by the collar 72.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A container assembly comprising:

a number of sidewall assemblies that include a first sidewall assembly that is a unitary body and a second sidewall assembly that is a unitary body;

each sidewall assembly including a plurality of associated sidewalls; and said associated sidewalls are coupled by a living hinge;

each sidewall including a generally planar perimeter and a number of tapered edge segments;

said first sidewall assembly includes three associated sidewalls disposed in series;

each first sidewall assembly sidewall is a generally rectangular, generally planar sidewall;

said first sidewall assembly movable between a generally flat, first configuration, wherein the planes of said associated sidewalls are generally parallel, and a folded, second configuration, wherein the planes of said sidewalls are generally perpendicular to an adjacent associated sidewall;

said second sidewall assembly includes three associated sidewalls disposed in series;

each second sidewall assembly sidewall is generally rectangular, generally planar sidewall;

said second sidewall assembly movable between a generally flat, first configuration, wherein the planes of said associated sidewalls are generally parallel, and a folded, second configuration, wherein the planes of said sidewalls are generally perpendicular to an adjacent associated sidewall; and when said first sidewall assembly is in said second configuration and said second sidewall assembly is in said second configuration, said first sidewall assembly and said second sidewall assembly are coupled to each other defining a generally parallelepiped generally enclosed space;

when said first sidewall assembly sidewalls and said second sidewall assembly sidewalls are disposed in an enclosing configuration, each overlapping tapered edge segment is coupled to an adjacent overlapping tapered edge segment; and each set of coupled tapered edge segments defining a reinforced edge that is one of a fastened reinforced edge, an adhered reinforced edge, or a bonded reinforced edge;

said first sidewall assembly outer sidewalls include tapered edge segments on corresponding longitudinal sides of the first sidewall assembly outer sidewalls;

said first sidewall assembly medial sidewall includes tapered edge segments on four sides;

said second sidewall assembly outer sidewalls include tapered edge segments on four sides;

said second sidewall assembly medial sidewall includes tapered edge segments on corresponding longitudinal sides of the second sidewall assembly medial sidewalls;

said first sidewall assembly medial sidewall tapered edge segments have a length substantially corresponding to the length of the associated sidewall side; said first sidewall assembly includes generally a number of triangular gussets; each of said gussets being disposed between adjacent medial sidewall tapered edge segments; said second sidewall assembly outer sidewalls tapered edge segments have a length substantially corresponding to the length of the associated sidewall side; and said second sidewall assembly includes generally a number of triangular gussets; and each of said gussets being disposed between adjacent outer sidewall tapered edge segments.

2. The container assembly of claim 1 wherein:

said first sidewall assembly sidewalls and said second sidewall assembly sidewalls are configured to form an enclosed configuration;

wherein each first sidewall assembly gusset is coupled to overlap with a respective adjacent second sidewall assembly gusset; and wherein each set of coupled gussets defines a reinforced gusset.

3. The container assembly of claim 2 wherein said reinforced gusset is one of a fastened gusset, an adhered gusset, or a bonded gusset.

4. The container assembly of claim 1 wherein said first sidewall assembly medial sidewall further comprises a primary opening.

5. The container assembly of claim 1 wherein:

said first sidewall assembly is configured to nest with a substantially similar first sidewall assembly when oriented in said first configuration; and said second sidewall assembly is configured to nest with a substantially similar second sidewall assembly when oriented in said first configuration.

6. The container assembly of claim 1 wherein:

said first sidewall assembly sidewalls and said second sidewall assembly sidewalls include features selected from the group consisting of coupling components, stand-off elements, windows, risers, and a combination thereof.

7. The container assembly of claim 1 wherein the tapered edge segments are angled relative to the sidewall plane between about 30 degrees and about 60 degrees.

8. The container assembly of claim 1 wherein the triangular gussets consist of approximately equilateral triangles.

9. The container assembly of claim 1 wherein the first sidewall assembly and the second sidewall assembly are fabricated from a material selected from the group consisting of plastic, poly material, and a combination thereof.

* * * * *